US006959659B1

(12) United States Patent
Burrell

(10) Patent No.: US 6,959,659 B1
(45) Date of Patent: Nov. 1, 2005

(54) ARTICULATED SAILING WATERCRAFT

(76) Inventor: James S. Burrell, 2523 Echo Hill Dr., Norco, CA (US) 92860

( * ) Notice: Subject to any disclaimer, the term of this patent is extended or adjusted under 35 U.S.C. 154(b) by 0 days.

(21) Appl. No.: 10/917,639

(22) Filed: Aug. 13, 2004

(51) Int. Cl.[7] ..... B63B 35/00
(52) U.S. Cl. ..... 114/39.27; 114/61.16
(58) Field of Search ..... 114/39.11, 39.27, 114/61.15, 61.16

(56) References Cited

U.S. PATENT DOCUMENTS 3,395,664 A * 8/1968 Greenberg et al. ..... 114/39.27
3,691,976 A * 9/1972 Wilson ..... 114/39.27
4,294,184 A * 10/1981 Heinrich ..... 114/61.16
4,671,198 A * 6/1987 des Snead ..... 114/39.27
4,757,777 A * 7/1988 Rosenberger ..... 114/39.27
5,134,950 A * 8/1992 Berte ..... 114/39.27
5,894,807 A * 4/1999 Aiken ..... 114/39.11

* cited by examiner

*Primary Examiner*—Lars A. Olson
(74) *Attorney, Agent, or Firm*—I. Michael Bak-Boychuk

(57) ABSTRACT

In a sailing catamaran provided with a forwardly directed pivoted arm carrying at the free end a third pontoon into alignment in front of either of the catamaran hulls a triangular truss assembly is provided bridging across the hulls. The apex of the truss assembly is then engaged to a point along the length of a mast which has its foot or base resting on the arm. A forestay stretched between the mast and the end of the arm supports a headsail while a mainsail is mounted on the mast.

13 Claims, 4 Drawing Sheets

FIG. 5
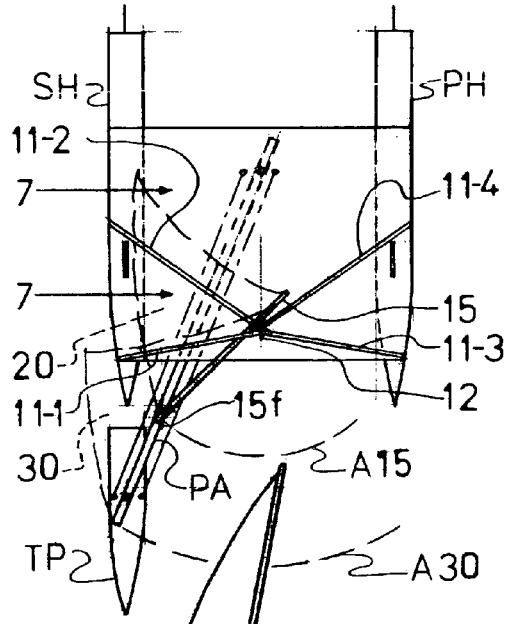
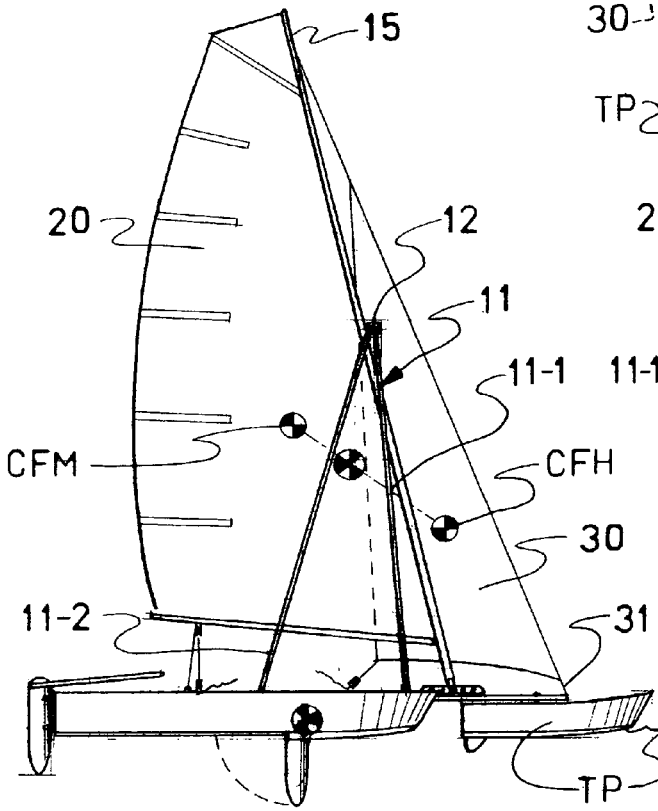
FIG. 3
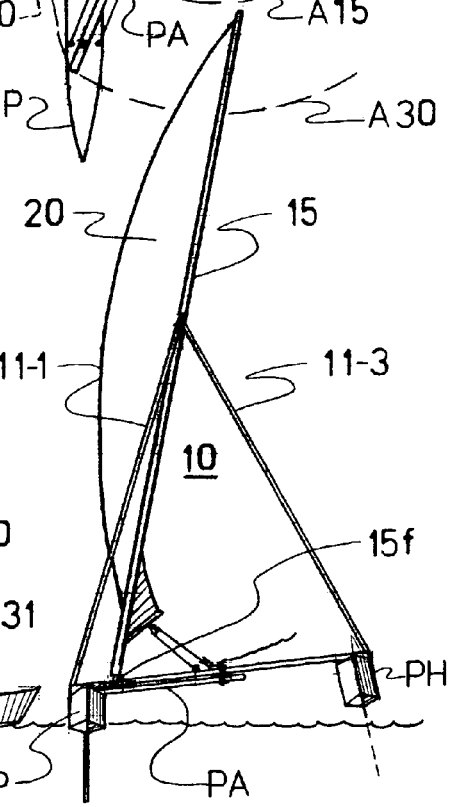
FIG. 4

ARTICULATED SAILING WATERCRAFT

BACKGROUND OF THE INVENTION

1. Field of the Invention

The present invention relates to sail driven watercraft, and more particularly to a sailing catamaran with its sails supported in a bridging trapeze to articulate along with an articulated third pontoon laterally displaced to align in front of the lee hull when tacking.

2. Description of the Prior Art

The inherent benefits of a sailing catamaran are universally well known and have been appreciated throughout, and even before, recorded history. Specifically, the wide spacing between the hulls of a catamaran allows for a very narrow hull shape with the consequent reduction in drag. Even earlier the low drag aspects of a long and narrow hull, stabilized by an outrigger, have been universally appreciated and there is some suggestion that it is this appreciation that has promoted human migration across the various Pacific islands. The asymmetric aspects of a single stabilizing outrigger, however, result in grossly asymmetrical sailing performance across and into the wind and the symmetry of a catamaran hull platform is therefore most often associated with the early development of sail surfaces in the Pacific. Simply, the symmetrical aspects of the catamaran platform appear to promote the desired sailing utility on both sides of the wind.

This beneficial symmetry of a catamaran, however, has its own disadvantages, namely the characteristically low performance of a catamaran when beating or sailing towards the wind. This loss of windward performance, which has become more pronounced as sail efficiency improved, stems from the inherent offset of the sail surfaces from the center of buoyancy, an offset that imposes a turning moment about the volumetric center of the lee hull. It is, of course, the combination of a symmetrical deployment of the sail rigging relative an asymmetrical buoyancy point that produces this moment, and the wider the catamaran platform the less efficient it is to the wind. As result most of the notorious sailing performers of current vintage are characteristically asymmetrical, with a strong preference for either the one or the other side of the wind.

Recently, however, a catamaran structure has been developed in which a third hull or pontoon can be articulated to align adjacent and ahead of either on of the two catamaran hulls, with the tack of a single sail tied to this moveable pontoon to be carried therewith. This novel hull development has been described by Alan Blundell, "*Vari-Scari; Philosophy and Development of the Design*" Publication 115, The Amateur Yacht Research Society, BCM AYRS, LONDON WC1N 3XX (1994). While the foregoing new development in catamaran architecture represents a significant advance in the art, its general acceptance has not followed, primarily because of the inherent difficulties in sail handling associated with the articulated sail tack where even the developer, himself, resorts to gybing as the primary method for changing tacks. In addition the above developer, while recognizing the benefits of a stepped hull, fails to optimize same. The resolution of both these deficits, along with other improvements, will therefore result in a highly efficient, fast and commercially viable catamaran structure and it this inventive resolution that is disclosed herein.

SUMMARY OF THE INVENTION

Accordingly, it is the general purpose and object of the present invention to provide a novel sail rigging arrangement useful with a catamaran provided with a third, articulated pontoon.

Other objects of the invention are to provide a sloop rigged sail arrangement conformed for articulation along with the articulation of a leading edge hull.

Further objects of the invention are to provide a stepped catamaran hull configuration having ventilation passages to ingest air into the space aft of the hull step.

Yet further objects of the invention are to provide an articulated catamaran structure which is easily fabricated and convenient in use.

Briefly, these and other objects are accomplished within the present invention by providing a generally triangular truss mounted across the hulls of the catamaran to suspend from the apex thereof a mast on which a mainsail is deployed. The foot or base of this mast is then selectively connected to one of several mounts on the pivoted arm which, at its end engages the articulated third pontoon. The luff of a headsail is then stretched between the pontoon connection of the arm and a point on the mast above the truss apex, thus forming the fore triangle, or forestay, with two pairs of rigid shroud pieces adjustably connected to the hulls to form the truss apex. In this manner the craft is generally conformed as a sloop rigged sailing catamaran in which the third pontoon is carried by the headsail to align ahead of the lee hull, moving the geometry of the sail rigging towards a vertical position. Along with this benefit the further convenience of tacking is achieved in a sail rig that essentially duplicates sloop rigging. Thus the widely familiar sail handling features of a sloop rig are effectively combined with a novel coordination of the sails and an articulated hull platform.

Those skilled in the art will appreciate that the foregoing configuration effectively combines the hull speed benefits of the pontoon increased length of the lee hull with a concurrent angulation of the sail rigging towards the vertical right above this hull. This increased sail effectiveness can then be further optimized by conforming each of the fixed hulls as a stepped hull with the upper hull surface opened both to trap the relative wind and to permit manipulation of pivoted fins or dagger boards extending through a lower opening that also serves to ventilate the step. The rear portions of each of the hulls are thus ventilated, reducing the surface drag thereof and thereby further improving vessel performance. In this manner all the advantages of the articulated vessel geometry are fully optimized with minimal added complexity for the user.

In this manner the added length of the lee hull increases its buoyancy, promoting planing, while also shifting the effective center of gravity along with the lateral motion thereof. As result, the lightened windward hull is more responsive to the body motions of the user effecting the necessary sail controls through the well familiar control provisions of a sloop rig. While in accordance with the prior art teachings the directional alignment of the third hull is controlled by a trapezoidal cable rig extending from the cross bridging along the pivoted arm to corresponding connections on the third pontoon, this directional rigging may be further augmented by a set of trim control lines extending over pulleys on each of the hulls again to the rearward control position of the user on the windward hull. These trim features, adjustments in mast rake geometry and the sail control lines of a sloop rig provide for full adjustment for optimum sailing performance.

More importantly, the stiff, but light weight, truss configuration bridging across the catamaran hulls synergistically combines with the effective light hull loading to promote planing which can then be finther optimized by a stepped hull surface that is even further optimized by a ventilation arrangement of the rear surface portions thereof. The windward cant of the masthead that results from this rigging geometry also obtains a net lifting component at low heel angles, thus further reducing the effective weight of the craft and the resulting immersed surface of the hull, decreasing drag. Thus the interesting features of the prior art teaching referred to above are inventively modified to result in a practical, efficient and inexpensive watercraft.

BRIEF DESCRIPTION OF THE DRAWINGS

FIG. 3 is a side view of the inventively rigged articulated catamaran sailing vessel;

FIG. 4 is a front view of the inventively rigged articulated sailing catamaran, illustrating the lateral mast movement towards vertical;

FIG. 5 is a diagrammatic illustration, in top view, depicting the relative motions of the inventive sail rigging along with the movement of the pivoted pontoon arm;

DESCRIPTION OF THE PREFERRED EMBODIMENT

Figure 1:
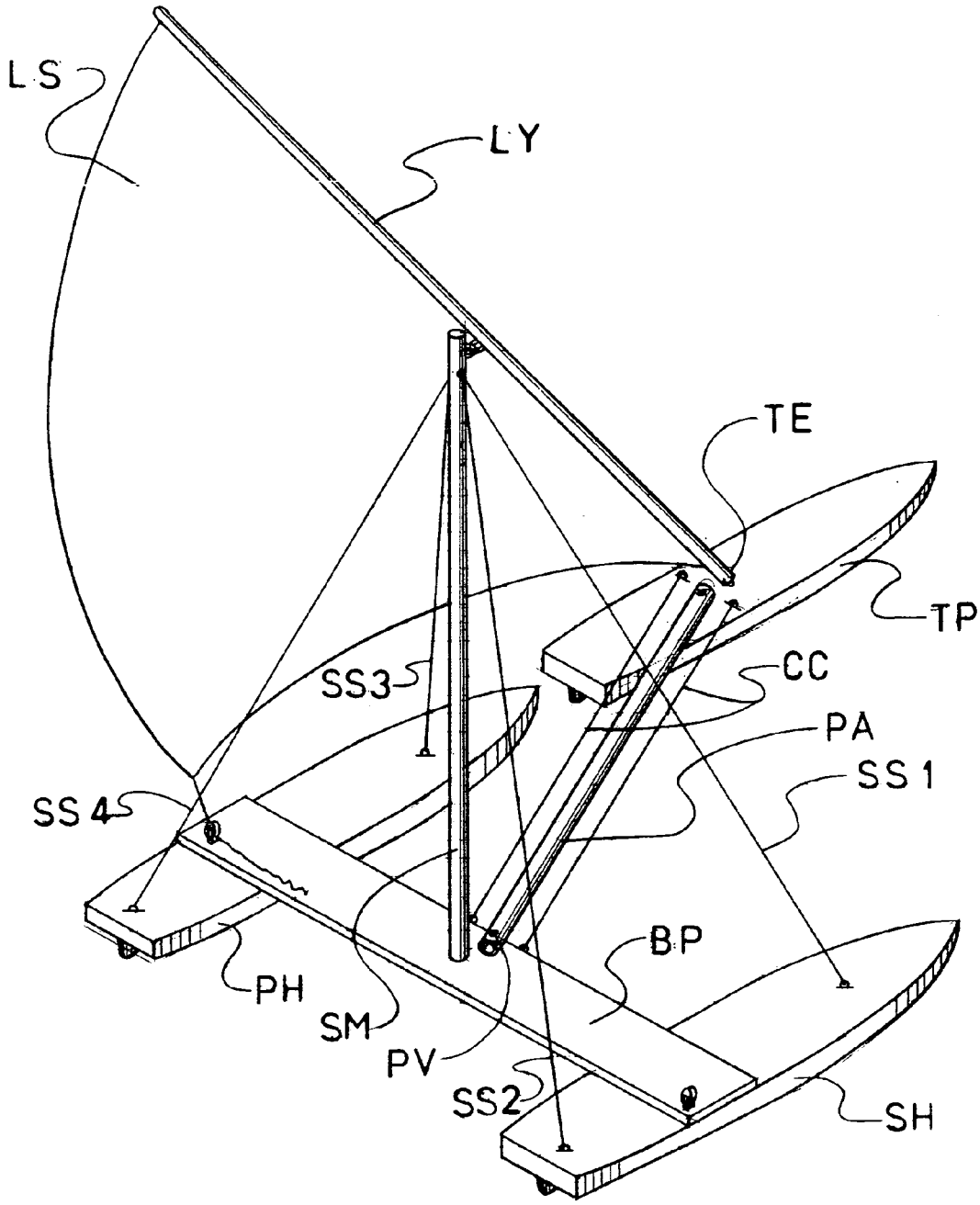
PRIOR ART FIG. 1
FIG. 1 is a perspective illustration of the prior art catamaran sailing vessel including the articulated third pontoon, as disclosed in the above referenced article captioned "*Vari-Scari; Philosophy and Development of the Design*"
Figure 2:
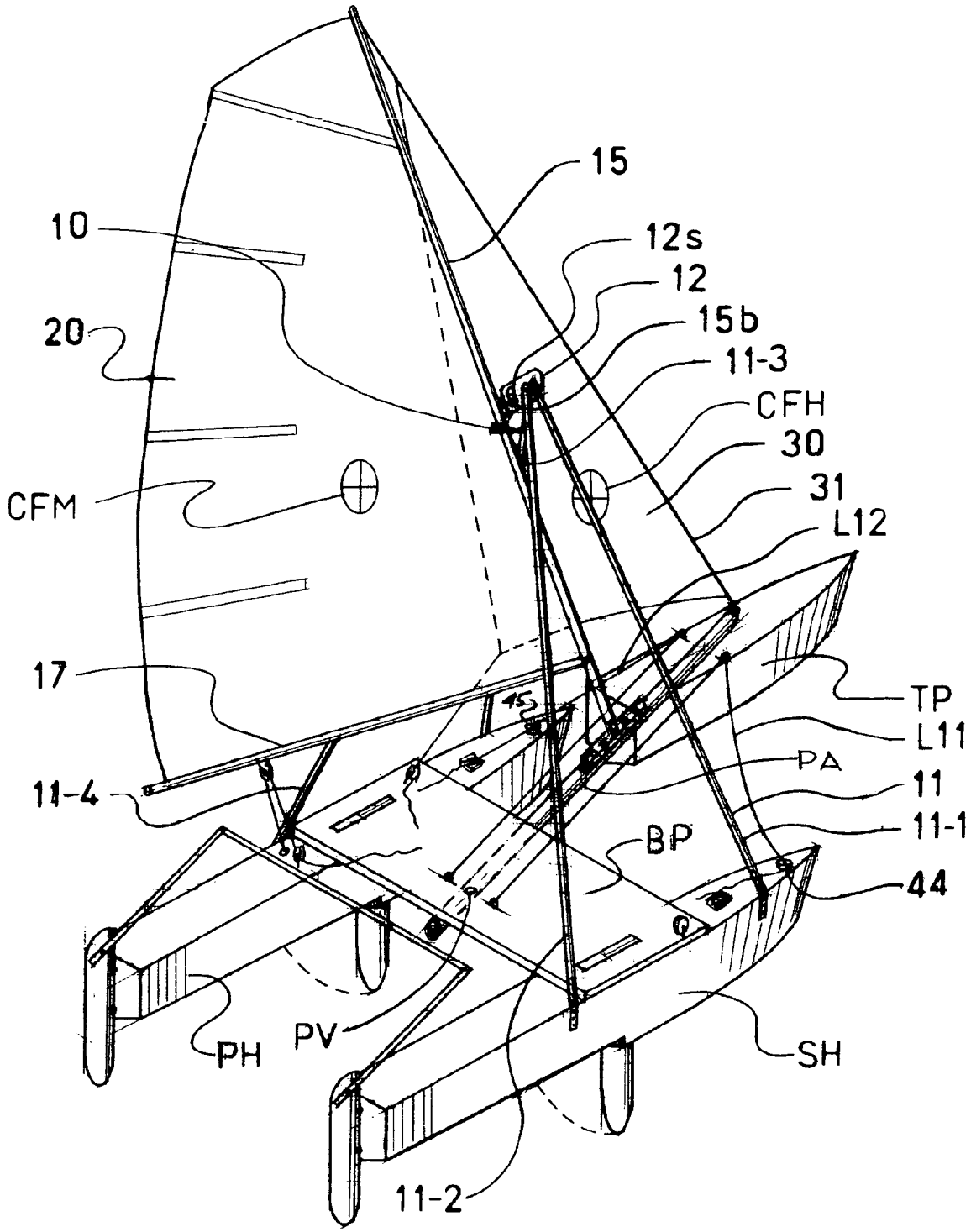
FIG. 2 is a further perspective illustration depicting the inventive modifications of the prior art vessel illustrated in FIG. 1 for rendering same convenient in the course of use.
Figure 6:
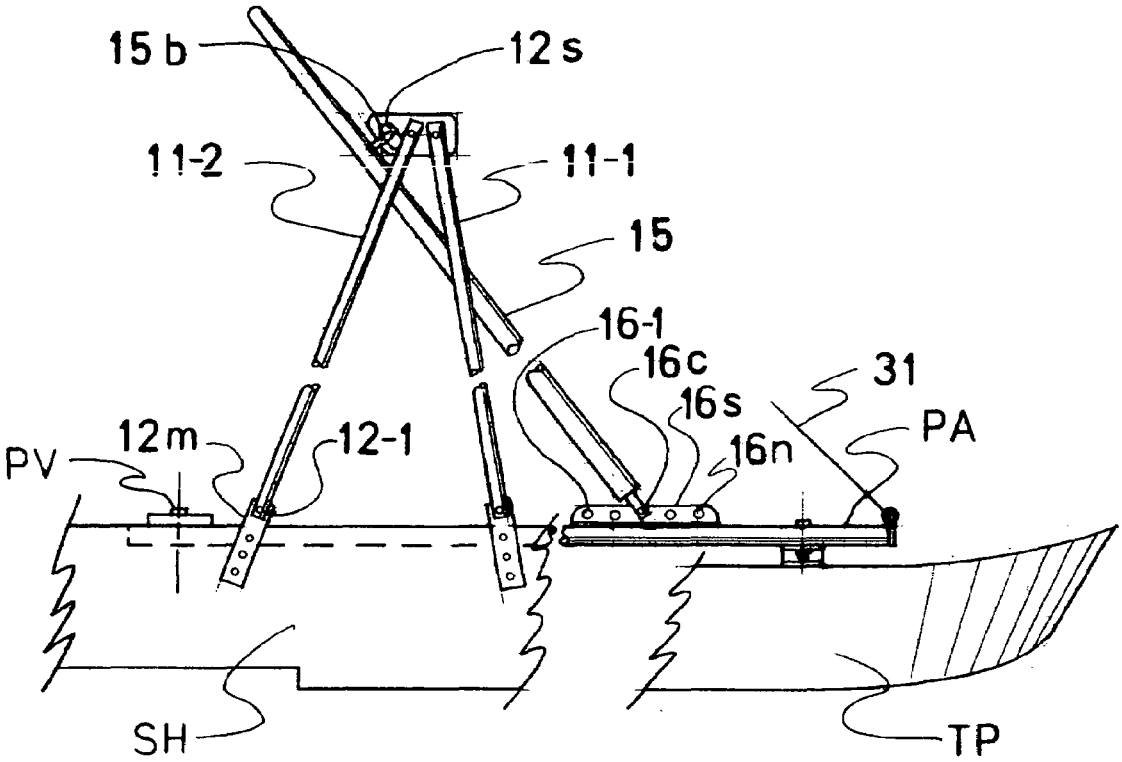
FIG. 6 is a side view detail illustrating the inventive suspension of the mast and the engagement thereof to the pivoted arm deploying the articulated third pontoon.
Figure 7:
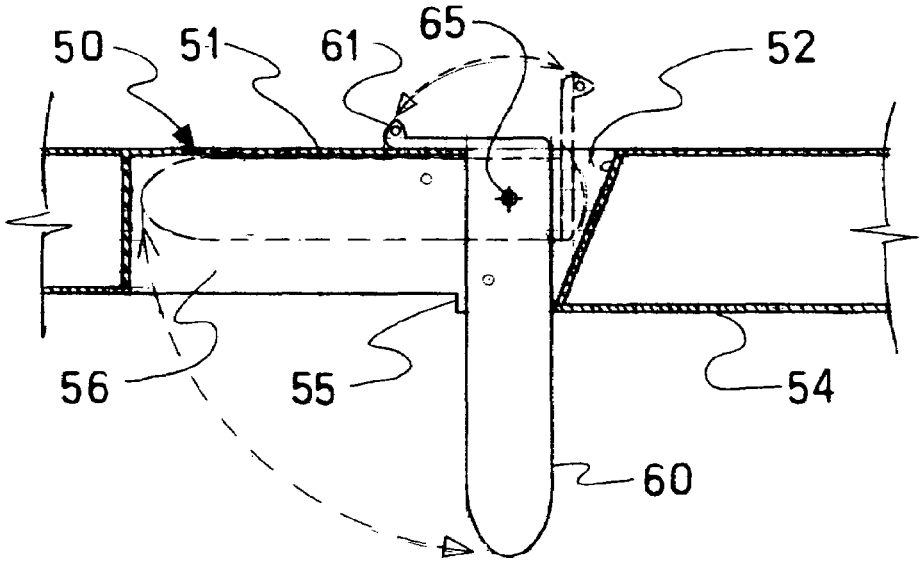
FIG. 7 is a sectional view detail taken along line 7—7 of FIG. 5 illustrating the venting path through each fixed hull that is also useful for storing pivotal fins when running down wind.

The prior art development of a sailing catamaran provided with a pivotally articulated third pontoon is best described by reference to FIG. 1 wherein the starboard and port hulls SH and PH, respectively, are fixed in spaced parallel alignment by a bridging piece BP which, at its center, supports a stub mast SM. A set of shrouds SS1–SS4 extending in pairs from the respective hulls are then utilized to rig the stub mast vertically to support the long yard LY (otherwise sometimes referred to as the crossbar) of what is most closely described as a lateen rigged sail LS. While in current practice sail LS may be fully battened and shaped for maximized performance, this particular rigging demands that, like in a windsurfer, directional changes are best effected by gybing. In the particular prior art example referred to herein the use of a lateen rig is dictated by a pivoted arm PA extending forwardly from a pivot PV centered on the bridging piece BP to articulate a third pontoon TP into alignment in front of either one of the hulls SH or PH while also articulating the forward end or the tack end TE of the yard LY. While the third pontoon is directionally controlled by a cable parallelogram CC extending from the bridging piece BP, this particular sailing rig results in a complex sail handling task and even though the effective hull length extension by the pontoon provides substantial increases in performance, the resulting difficult sail rigging and its off-set bias towards the platform center detract from this increased hull performance.

By reference to FIGS. 2 through 7 an alternative sail arrangement is described, under the general designation by the numeral 10, deployed for coordinated movement with the pivoted arm PA in a manner that both simplifies handling while also optimizing the alignments of the aerodynamic forces thereon relative the leeward, or loaded, hull. Like labeled parts functioning in like manner to those previously described, this sailing rig 10 is mounted onto the catamaran platform again formed by the bridging piece BP spanning between the starboard and port catamaran hulls SH and PH respectively, engaged like in the prior art example described above to a forwardly directed arm PA pivoted from the center of the bridging piece to deploy a third pontoon TP at the free end thereof ahead of either one of the hulls. A truss structure 11 defined by a set of paired and triangulated rigid shroud pieces 11-1–11-4 is then adjustably mounted on the hulls over the bridging piece BP, thereby forming a stiff, light weight skeleton for the rigging 10 to deploy an upper apex piece 12 at the common apex juncture of the shroud pieces.

Apex piece 12 includes a rearward, generally vertical, slot 12*s* engaged by a bracket 15*b* supporting a mast 15 along the length thereof, with the foot or base of the mast 15*f* then selectively pinned by a clevis pin 16*c* to one of several mount openings 16-1–16-*n* formed in a spine piece 16*s* along the length of the arm PA. In this manner a selectively adjustable rake is provided to the mast 15 with further fore and aft adjustment obtained for the upper apex 12 by similar engagement points 21-1 through 21-*m* along the lower ends of the two rearward shroud pieces 11-2 and 11-4. A boom 17 is then pivotally engaged to mast 15 to support a mainsail 20 therebetween. By this arrangement the rear rigging triangle is formed without the usual rear stays with the whole rigging structure right over the bridge piece BP also providing a light weight and rigid connection between the two hulls.

Having thus fixed the mast to the arm by triangulation, a forestay 31 may be stretched from a point above the apex piece 12 to the free end of the arm PA to support the leading edge of a headsail, or jib, 30 thereon, thus forming together with the mainsail a sailing rig generally known as sloop rigging. Of course, the appropriate and well known control connections such as the mainsheet and the jib sheets can then be provided to effect the sail controls, with a set of further lines L11 and L12 extending from the respective sides of arm PA over pulleys 44 and 45 on hulls SH and PH, respectively, providing convenient trimming adjustment of the limits for the lateral swing of the arm.

Those skilled in the art will appreciate that the foregoing arrangement determines that the movement arc A15 of the base 15*f* of the mast 15 is defined by the selected length of arm PA between the pivot PV and the selected engagement point 16-1–16-*n*. In coordinated relationship the tack attachment of the jib 30 also travels with the pivotal motion of arm PA, but along a larger arc A30 defined by the full length of the arm. This geometry effectively accommodates the lower center of aerodynamic force CFH usually obtained from a headsail and the somewhat higher, but rearward, center of pressure CFM of the mainsail to produce stable restoring moments into the wind. Of course, both arcs A15 and A30 are limited by the trimming adjustment of lines L11 and L12.

This same coordinated motion along with the motion of the third pontoon TP into alignment with the lee hull moves both the centers of pressure towards the loaded hull while also canting the top of the mast 15 towards the wind to compensate for the effective area loss due to heeling. As a consequence to these inherent stability attributes a single user of the sailing craft thus implemented can then, from a position on the windward hull, effect all the necessary controls.

Those in the art will further appreciate that the increased effective length of the lee, or the loaded, hull results in a lower unit area loading and therefore a lesser displacement immersion. As result, planing speed is more easily achieved, particularly if the hull section beam is increased or widened. To take further benefit of this planing facility each of the hulls, and even the third pontoon, may be stepped with the stepped geometry and the provision of articulated fins then being combined to provide a ventilation path to the hull surfaces behind the step. By particular reference to FIG. 7 wherein the each hull structure SH and PH is exemplified as hull 50 the upper hull surface 51 is provided with an opening 52 for receipt of a rearwardly pivoted handle piece 61 at the upper end of a fin 60. The lower hull surface 54, behind a step 55, is similarly provided with an opening 56 which accommodates the pivotal extension of fin 60 as the handle piece 61 is moved about its pivot 65. In this manner a ventilation path is formed through the hull to the negative pressure area right behind the step effectively reducing the wetted hull surface and the surface drag associated therewith. This same ventilation path then also accommodated the deployment and withdrawal of the directional fins.

The resulting increased speed performance of the hulls and the familiar geometry of sloop rigging can then be effectively combined to take benefit of known sail performance enhancing techniques such as those obtained in a fully battened sail or those associated with an increased aspect ratio of the sail. Thus all the benefits of current sail technology and those of a planing hull can be easily combined with the necessary facility of a removable fin further enhanced by the ventilation path directly into the juncture of the fin with the hull, a juncture known for its usually associated interference drag. In this manner an effective, high performance, sailing craft is provided that is easily fabricated and assembled for use.

Obviously, many modifications and variations can be effected without departing from the spirit of the invention instantly disclosed. It is therefore intended that the scope of the invention be determined solely by the claims appended hereto.

I claim:

1. In a sailing catamaran characterized by a starboard and port hull fixed in a generally parallel alignment relative each other by a bridging piece spanning therebetween including an arm pivotally connected to said bridging piece to extend forwardly therefrom and having the free end thereof engaged to a third pontoon for pivotal translation thereof ahead of a selected one of said starboard or port hulls, the improvement comprising:

a triangulated truss assembly connected across said starboard and port hulls in alignment over said bridging piece including a mount at the apex thereof;

a mast defined by an upper end and a lower end slidably engaged along the length thereof to said mount and having the lower end thereof engaged to said arm distal of the free end thereof;

a forestay connected between said mast, at a point above said mount, and the free end of said arm;

a mainsail mounted on said mast; and a headsail mounted on said forestay.

2. A sailing craft according to claim 1 wherein:

said mainsail and headsail each include control connections for determining the deployment thereof.

3. A sailing craft according to claim 2, further comprising:

trimming means connected to said arm for selecting the limits of the pivotal motion thereof.

4. A sailing craft according to claim 3, wherein:

said truss assembly is adjustably connected to said starboard and port hulls for providing a selective adjustment of the apex thereof.

5. In a sailing catamaran characterized by a starboard and port hull fixed in a generally parallel alignment relative each other by a bridging piece spanning therebetween including an arm pivotally connected to said bridging piece to extend forwardly therefrom and having the free end thereof engaged to a third pontoon for pivotal translation thereof ahead of a selected one of said starboard or port hulls, the improvement comprising:

a triangulated truss assembly connected across said starboard and port hulls in alignment over said bridging piece including a mount at the apex thereof;

a mast defined by an upper end and a lower end slidably engaged along the length thereof to said mount and having the lower end thereof engaged to said arm distal of the free end thereof; and a forestay connected between said mast, at a point above said mount, and the free end of said arm.

6. A sailing craft according to claim 5, wherein:

said starboard and port hulls each include an upper and a lower surface, each said lower surface including a step along the length thereof.

7. A sailing craft according to claim 6, wherein:

each said starboard and port hull include a ventilation path from each said upper surface thereof to the corresponding lower surface thereof adjacent said step.

8. A sailing craft according to claim 7, further comprising:

each said starboard and port hull including a corresponding starboard and port fin each pivotally deployable through the corresponding one of said ventilation paths to extend subjacent the corresponding one of said lower surfaces.

9. A sailing craft according to claim 5, further comprising:

a boom connected to said mast proximate the lower end thereof;

a mainsail mounted on said mast and said boom; and a headsail mounted on said forestay.

10. A sailing craft according to claim 5, wherein:

said lower end of said mast is selectively connected at one of several points along said arm.

11. A sailing craft according to claim 10 wherein:

said mainsail and headsail each include control connections for determining the deployment thereof.

12. A sailing craft according to claim 11, further comprising:

trimming means connected to said arm for selecting the limits of the pivotal motion thereof.

13. A sailing craft according to claim 12, wherein:

said truss assembly is adjustably connected to said starboard and port hulls for providing a selective adjustment of the apex thereof.

* * * * *